US008988286B2

(12) United States Patent
Ahn et al.

(10) Patent No.: US 8,988,286 B2
(45) Date of Patent: Mar. 24, 2015

(54) MULTI-BAND ANTENNA FOR PORTABLE TERMINAL WITH RADIATORS ON OPPOSITE SURFACES OF SUBSTRATE

(75) Inventors: Jung-Ho Ahn, Seoul (KR); Seung-Hwan Kim, Seoul (KR); Austin Kim, Gyeonggi-do (KR); Dong-Hwan Kim, Gyeonggi-do (KR); Jae-Ho Lee, Gyeonggi-do (KR); Sung-Min Her, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 584 days.

(21) Appl. No.: 12/852,568

(22) Filed: Aug. 9, 2010

(65) Prior Publication Data

US 2011/0037665 A1 Feb. 17, 2011

(30) Foreign Application Priority Data

Aug. 17, 2009 (KR) ..... 10-2009-0075683

(51) Int. Cl.
*H01Q 1/38* (2006.01)
*H01Q 9/42* (2006.01)
*H01Q 5/00* (2006.01)

(52) U.S. Cl.
CPC ..... *H01Q 9/42* (2013.01); *H01Q 5/0051* (2013.01); *H01Q 5/0062* (2013.01)
USPC ..... 343/700 MS; 343/713; 343/846; 343/895; 343/873

(58) Field of Classification Search
USPC ..... 343/702, 713, 700 MS, 846, 895, 873, 343/876
See application file for complete search history.

(56) References Cited

U.S. PATENT DOCUMENTS

| | | | | |
|---|---|---|---|---|
| 2005/0007279 | A1* | 1/2005 | Chang | 343/700 MS |
| 2006/0145925 | A1* | 7/2006 | Mei | 343/700 MS |
| 2006/0170598 | A1* | 8/2006 | Kwan et al. | 343/702 |
| 2009/0002244 | A1* | 1/2009 | Woo | 343/702 |
| 2009/0251385 | A1* | 10/2009 | Xu et al. | 343/911 R |
| 2010/0053007 | A1* | 3/2010 | Ni et al. | 343/745 |

* cited by examiner

*Primary Examiner* — Sue A Purvis
*Assistant Examiner* — Jae Kim
(74) *Attorney, Agent, or Firm* — Cha & Reiter, LLC

(57) ABSTRACT

A multi-band built-in antenna of a portable terminal is provided. The antenna includes a first antenna radiator on a front surface of a substrate (e.g., a main board), and a second antenna radiator on an opposite surface of the substrate. The substrate has ground surfaces on both sides separated from a non-ground area on which the radiators are disposed. The first radiator may be in the form of a Planar Inverted F Antenna (PIFA), with a first end branched off into two parts, one part used for power feeding and the other part electrically coupled to the ground surface. The first radiator has a portion that extends from the first end to an opposite end. The second radiator is continuous from the opposite end of the first radiator through a via (hole) in the main board.

15 Claims, 5 Drawing Sheets

MULTI-BAND ANTENNA FOR PORTABLE TERMINAL WITH RADIATORS ON OPPOSITE SURFACES OF SUBSTRATE

CLAIM OF PRIORITY

This application claims the benefit of priority, under 35 U.S.C. §119(a) of that Korean patent application filed in the Korean Intellectual Property Office on Aug. 17, 2009 and assigned Serial No. 10-2009-0075683, the entire disclosure of which is hereby incorporated by reference in its entirety.

BACKGROUND OF THE INVENTION

1. Field of the Invention

The present invention relates to a built-in antenna of a portable terminal. More particularly, the present invention relates to a multiband built-in antenna of a portable terminal for simplifying a manufacturing process, reducing an assembly cost, and achieving a slimmer design.

2. Description of the Related Art

Today, terminals have various functions and designs. Although the terminals are becoming lighter, thinner, and simpler, the functions of the terminals are still important to meet user's demands. Thus, it desirable to reduce the volume of the terminals while maintaining or improving the functions of the terminals.

Among the aforementioned terminals, a folder type terminal and a slide type terminal are particularly dominant in the market. This is because, when the terminal is not used or is carried, the length of the terminal in the carrying position is reduced by half relative to an operating state by folding or sliding a sub body back within a main housing.

However, a bar type terminal equipped with a Liquid Crystal Display (LCD) module in a front surface thereof has been widely used in recent years. This is because the terminal operates by using a touch screen while avoiding a keypad utilizing a metal dome as user's preference varies. In this type of terminal, an outwardly protruding antenna has been conventionally deployed. For example, a rod antenna (or a whip antenna) and a helical antenna which protrude outwardly by a specific length from the terminal have been used, but these antennas are most susceptible to drop damage and reduce portability of the terminal. Therefore, a built-in antenna (i.e., so called an 'internal antenna' or an 'intenna') installed inside the terminal is now widely used. Various efforts have been made to improve a characteristic of the built-in antenna to improve assembly capability and productivity.

The aforementioned plate type antenna is installed on a carrier having a specific height and provides a distance between a ground surface and a main board located in a lower portion thereof, thereby implementing smooth radiation performance. Further, the antenna is typically configured to implement multiple bands (e.g., at least two resonance points) by using one radiator. This is because a slot pattern on a front surface of the radiator can be formed in various manners according to each desired band. For example, since Wideband Code Division Multiple Access (WCDMA), a Digital Cellular System (DCS), and a Global System for Mobile Communication (GSM) can be used together by one terminal, the terminal having such design can be used more conveniently.

Meanwhile, in recently introduced slide type terminals, bar type terminals, folder type terminals, etc., the aforementioned multiband antenna is located near a lower portion of a main body, i.e., near a position where a speaker is installed. More particularly, the antenna radiator is installed in a direction of a front surface of the terminal. This is one way of utilizing a limited space of the terminal efficiently which is continuously becoming slimmer.

However, as described above, the implemented antenna requires an additional carrier and is equipped with the antenna radiator in which a specific pattern is formed in an upper portion of the carrier. Therefore, there is a problem in that the antenna occupies a useful inner space of the terminal and an installation position is limited. Further, the number of constitutional parts of the terminal increases which in turn increases the assembly cost. Increasing components inside the terminal is not desirable when the trend is for a slimmer terminal.

SUMMARY OF THE INVENTION

An exemplary aspect of the present invention is to solve at least the above-mentioned problems and/or disadvantages and to provide at least the advantages described below. Accordingly, an aspect of the present invention is to provide a multiband built-in antenna of a portable terminal implemented to reduce an assembly cost by decreasing the number of constitutional parts.

Another exemplary aspect of the present invention is to provide a multiband built-in antenna of a portable terminal implemented to facilitate in realizing a slim terminal by constructing the terminal with relatively no restriction on an installation space and an installation position.

Another exemplary aspect of the present invention is to provide a multiband built-in antenna of a portable terminal implemented to be able to prevent radiation performance deterioration while contributing in realizing a slim terminal.

In accordance with an exemplary aspect of the present invention, a multiband built-in antenna of a portable terminal includes a main board having a ground area and a non-ground area on a front surface and an opposite surface, and an antenna radiator having a specific pattern directly formed on the non-ground area of the main board, wherein the antenna radiator comprises a first antenna radiator of which one end is branched off into two parts on the front surface of the main board so that one part is used for feeding and the other part is electrically coupled to the ground area, and of which the other end is extended by a specific length in a widthwise direction of the terminal, and a second antenna radiator which protrudes towards the opposite surface of the main board from the other end of the first antenna radiator and is formed in a specific pattern in the non-ground area on the opposite surface of the main board.

In accordance with an exemplary aspect of the present invention, a portable terminal includes: an antenna having a main board having a ground area and a non-ground area on a front surface and an opposite surface thereof; and an antenna radiator having a predetermined pattern directly formed on the non-ground area of the main board, the antenna radiator further comprises: a first antenna radiator of which one end is branched off into two parts on the front surface of the main board so that one part is used for power feeding and the other part is electrically coupled to the ground area and extended by a specific length in a widthwise direction of the terminal, and a second antenna radiator which protrudes towards the opposite surface of the main board and continuous from the other end of the first antenna radiator and formed in the non-ground area on the opposite surface of the main board.

BRIEF DESCRIPTION OF THE DRAWINGS

The above and other aspects, features and advantages of certain exemplary embodiments of the present invention will be more apparent to those skilled in the art from the following detailed description taken in conjunction with the accompanying drawings, in which.

DETAILED DESCRIPTION

The following description, with reference to the accompanying drawings, is provided to assist in a comprehensive understanding of certain exemplary embodiments of the invention provided herein for illustrative purposes. The description includes various specific details to assist a person of ordinary skill the art with understanding the claimed invention, but these details are to be regarded as merely exemplary. Accordingly, those of ordinary skill in the art will recognize that various changes and modifications of the illustrative examples described herein can be made without departing from the spirit of the invention and the scope of the appended claims. Also, descriptions of well-known functions and constructions may be omitted for clarity and conciseness as their inclusion may obscure appreciation of the subject matter of the claimed invention by a person or ordinary skill in the art.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural references unless the context clearly dictates otherwise. Thus, for example, a reference to "a component surface" includes reference to one or more of such surfaces.

By the term "substantially" it is typically meant that the recited characteristic, parameter, or value need not be achieved exactly, but that deviations or variations, including but in no way limited to, for example, tolerances, measurement error, measurement accuracy limitations and other factors known to persons of ordinary skill in the art, may occur in amounts that do not preclude the effect the characteristic was intended to provide.

Although a bar type terminal is illustrated in describing the present invention, the present invention is not limited thereto. Thus, the teachings of the present invention can apply to various well-known types of terminals (e.g., a slide type terminal, a folder type terminal, etc.).

Figure 1:
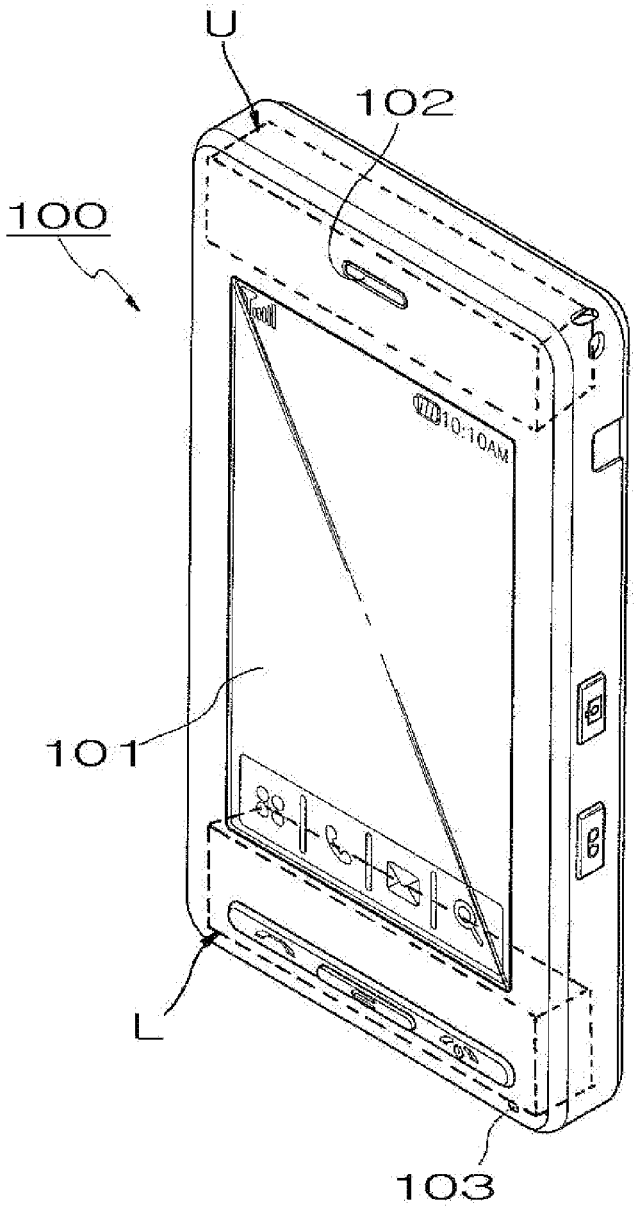
FIG. 1 is a perspective view of a portable terminal employing a built-in antenna according to an exemplary embodiment of the present invention.

FIG. 1 is a perspective view of a portable terminal 100 employing a built-in antenna according to an exemplary embodiment of the present invention. As shown, a wide Liquid Crystal Display (LCD) module 101 is installed in a front surface of the terminal. For example, the LCD module 101 is preferably installed with a touch screen. An upper portion of the LCD module 101 is installed with an earpiece 102 as a receiver. A lower portion of the LCD module 101 is installed with a microphone 103 as a transmitter. Although not shown, a camera, and a speaker can be further installed, and various additional devices can be installed to implement other well-known features.

Meanwhile, the built-in antenna (indicated by a reference numeral 1 in FIG. 2) of the present invention can be disposed in various locations of the portable terminal 100. Thus, an installation position is relatively more flexible than the conventional case where a carrier installation space is limited and thus the built-in antenna has to be installed in any one particular place even though a spatial expansion is sacrificed to some extent. Therefore, the built-in antenna of the present invention can be installed relatively in various positions in any inner space of the portable terminal in which a main board is installed. Preferably, the antenna can be installed at a lower portion L or an upper portion U of the terminal in order to achieve the required performance.

Figure 2:
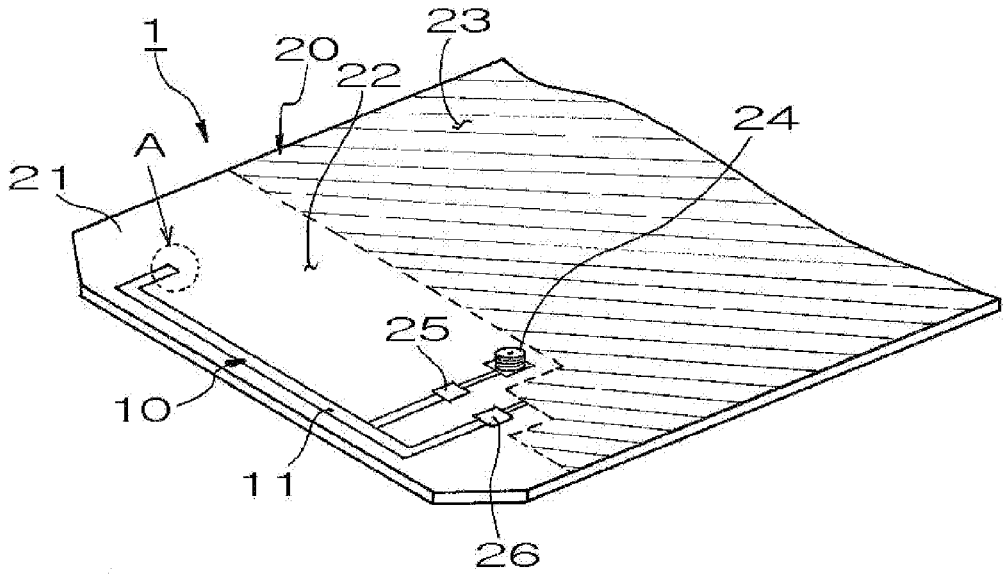
FIG. 2 is a perspective view partially illustrating major parts on a front surface of a main board of a portable terminal using a built-in antenna of the present invention.
Figure 3:
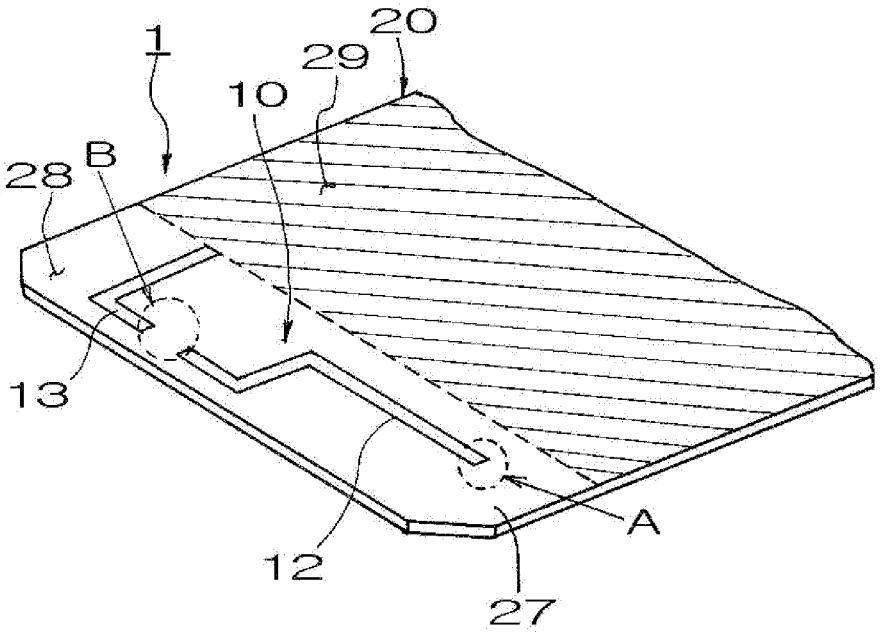
FIG. 3 is a perspective view partially illustrating major parts on an opposite surface of a main board of a portable terminal using a built-in antenna of the present invention.

FIG. 2 is a perspective view partially illustrating major parts on a front surface of a main board of a portable terminal using the built-in antenna 1 of the present invention. FIG. 3 is a perspective view partially illustrating major parts on an opposite surface of a main board of a portable terminal using the built-in antenna 1 of the present invention.

The built-in antenna 1 of the present invention includes a main board 20 installed inside the portable terminal 100 and an antenna radiator 10 installed or formed on one surface of the main board 20 (as illustrated both in FIG. 2 and FIG. 3).

The antenna radiator 10 can be implemented in a pattern type together when the main board (or substrate) 20 is formed, but the present invention is not limited thereto. The antenna radiator 10 may be a metal plate having a specific pattern and attached to the main board. In addition, the antenna radiator 10 may be a Flexible Printed Circuit (FPC) having a specific pattern.

The main board 20 of the present invention is divided into a ground area 23 and a non-ground area 22. The antenna radiator 10 of the present invention is preferably formed in the non-ground area 22 instead of a ground area 23.

As illustrated in FIG. 2, a front surface 21 of the main board 20 is provided with a first antenna radiator 11. Preferably, the antenna radiator 10 can be implemented by performing a patterning process when the main board 20 is formed. One end of the first antenna radiator 11 is branched off into two parts so that one part is electrically coupled to a power feeding pad 25, which is electrically coupled to a Radio Frequency (RF) connector 24, and the other part is electrically coupled to the ground area 23 through a path including pad 26. That is, a Planar Inverted-F Antenna (PIFA) type antenna radiator can be implemented.

The other end (portion 'A' in FIG. 2) of the first antenna radiator 11 is extended by a via (hole) to an opposite surface (i.e., a rear surface) 27 of the main board 20 in a portion A as illustrated in FIG. 2. This is referred to as a second antenna radiator 12. The second antenna radiator 12 is extended by a specific length and is then bent. In this case, the second antenna radiator 12 has a closed loop shape in the area "C" in conjunction with the first antenna radiator 11 by being superposed when the first antenna radiator 11 and the second antenna radiator 12 overlap with each other. More particularly, the second antenna radiator 12 is formed in a shape for improving the resonance, where the shape forms the rectangle surrounding the area "C". Further, the second antenna radiator 12 is implemented in a non-ground area 28 of the opposite surface 27 of the main board 20 instead of a ground area 29.

Meanwhile, if the antenna radiator 10 is a metal plate or an FPC, it may be implemented by detouring one side of the main board.

Figure 4:
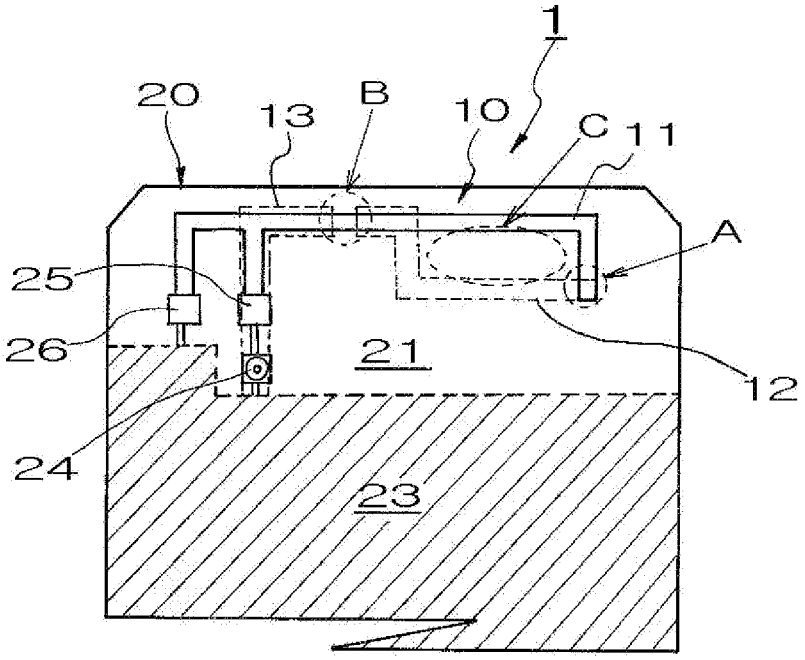
FIG. 4 illustrates a state in which a built-in antenna is installed on a surface of a main board according to an exemplary embodiment of the present invention.

As illustrated in FIGS. 3 and 4, one end of the a third antenna radiator 13 is electrically coupled to the ground area 29 located in the opposite surface 27 of the main board 20, and the other end thereof is superposed along the same line of an end portion of the first antenna radiator 11 oriented in the widthwise direction of the terminal and is separated by a specific distance from the second antenna radiator 12.

FIG. 4 illustrates a state in which a built-in antenna 1 is installed on a surface of a main board 20 according to an exemplary embodiment of the present invention. A first radio radiator 11 operates at a relatively low band. Therefore, the first antenna radiator 11 is preferably formed with a length of λ/4. A second antenna radiator 12 operates at a high band due to a rectangular-type resonance space (loop structure) (indicated by a portion C of FIG. 4) formed in conjunction with the first antenna radiator 11. A third antenna radiator 13 is electrically coupled to a ground area 29 of an opposite surface 27 of the main board 20 and thus further extends a bandwidth of the high band caused by coupling of a portion B of FIG. 4.

Preferably, in order to extend the bandwidth to the maximum extent possible, the third antenna radiator 13 may be bent after being formed on an area corresponding to a power feeding pattern branched off from the first antenna radiator 11. After being bent, it can be disposed in an area corresponding to a pattern of the first antenna radiator 11.

Figure 5:
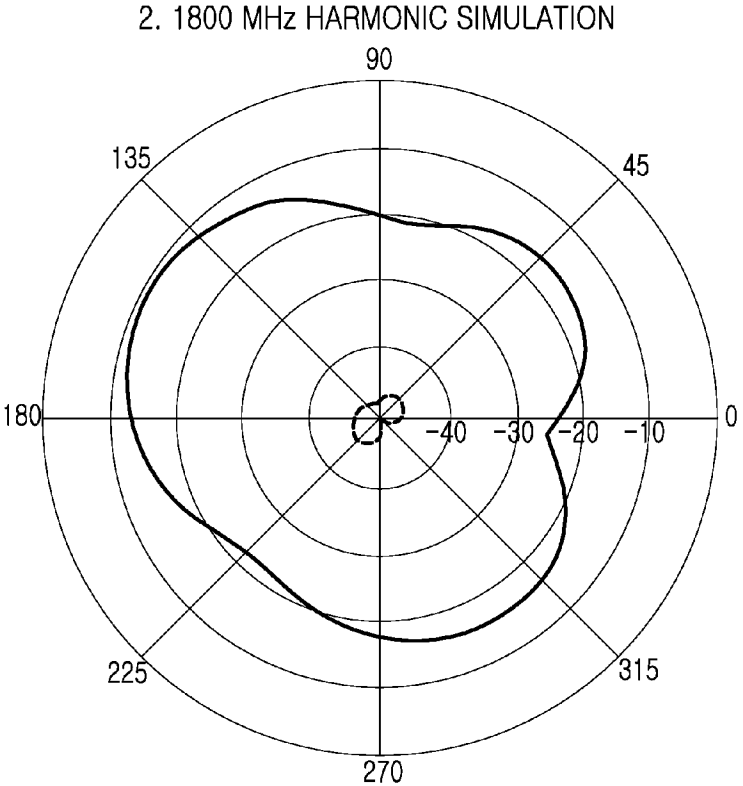
FIG. 5 illustrates an actual radiation efficiency measured at a low band and a high band in a built-in antenna according to an exemplary embodiment of the present invention.
Figure 5:
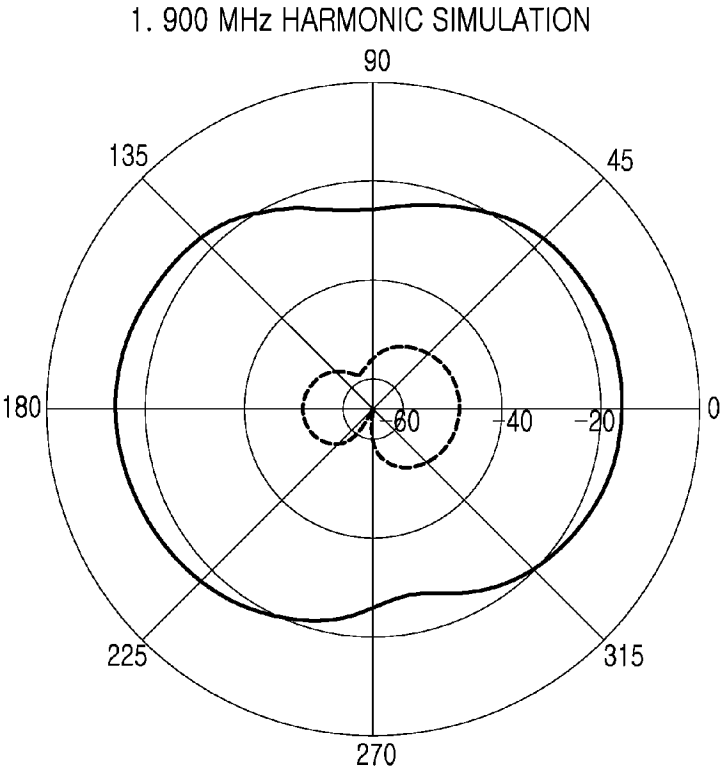

FIG. 5 illustrates an actual radiation efficiency measured at a low band and a high band in a built-in antenna according to an exemplary embodiment of the present invention.

Here, in FIG. 5, dotted lines represent vertical radiation patterns and solid lines represent horizontal radiation patterns. It can be seen that the built-in antenna can have the same performance as a typical carrier type antenna radiator. Specifically, the antenna according to the present invention exerts radiation efficiencies of 28.5% and 34.7% in 900 MHz harmonic simulation and 1,800 MHz harmonic simulation which are above the radiation efficiency of general carrier type antennas (around 25%). According to exemplary embodiments of the present invention, a built-in antenna has a radiator implemented on a surface of a main board, and thus an installation space and an installation position can be relatively freely selected due to the exclusion of a carrier, which can contribute to realizing a slimmer terminal.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A multiband antenna of a portable terminal, comprising:

a substrate having a ground area and a non-ground area on each of a front surface and an opposite surface thereof; and an antenna radiator comprising:

a first antenna radiator disposed on the non-ground area of the front surface of the substrate, having a first end branched off into two parts on the front surface so that one part is used for power feeding and the other part is electrically connected to the ground area of the front surface, the first antenna radiator having a portion that extends from the first end towards an opposite end;

a second antenna radiator disposed on the non-ground area of the opposite surface, and continuous from the opposite end of the first antenna radiator through a via in the substrate; and a third antenna radiator on the opposite surface, driven through coupling from the second antenna radiator, the third antenna radiator aligned with the one part used for power feeding and having one end separated by a specific interval for coupling with an end portion of the second antenna radiator to extend a bandwidth of the multiband antenna;

wherein the first and second antenna radiators are arranged to overlap to form a loop structure with respect to one another, the loop structure defining only a single loop forming a central region that is devoid of the first and second antenna radiators on the front and opposite surfaces of the substrate.

2. The multiband antenna of claim 1, wherein the loop structure is a rectangular loop structure, and the loop structure is configured to improve a high band resonance condition of the second antenna radiator.

3. The multiband antenna of claim 1, wherein the third antenna radiator comprises a first portion in a position superposed to a feeding pattern branched off from the first antenna radiator and a second portion superposed to the portion of the first antenna radiator that extends from the first end towards the opposite end by being bent at the first portion.

4. The multiband antenna of claim 3, wherein the first antenna radiator has a length of λ/4.

5. The multiband antenna of claim 4, wherein the substrate is a main board of the portable terminal, and the antenna radiator is configured with a pattern which has a specific width and a specific length and which is patterned together when the main board is formed.

6. A multiband antenna of a portable terminal, comprising:

a substrate having a ground area and a non-ground area on each of a front surface and an opposite surface thereof; and an antenna radiator comprising:

a first antenna radiator disposed on the non-ground area of the front surface of the substrate, having a first end branched off into two parts on the front surface so that one part is used for power feeding and the other part is electrically connected to the ground area of the front surface, the first antenna radiator having a portion that extends from the first end towards an opposite end; and a second antenna radiator disposed on the non-ground area of the opposite surface, and continuous from the opposite end of the first antenna radiator through a via in the substrate;

wherein the first and second antenna radiators are arranged to overlap to form a loop structure with respect to one another, the loop structure forming a central region that is devoid of the first and second antenna radiators on the front and opposite surfaces of the substrate, the opposite end of the first antenna radiator has a section bent from the portion extending in a widthwise direction of the terminal and ending at a location of the via, and the second antenna radiator is in the form of a first section extending from the via in the widthwise direction of the terminal, a central section bent from the first section and extending to a position coinciding with the portion of the first antenna radiator so as to form the closed loop structure, and a third section bent from the central section.

7. The multiband antenna of claim 4, wherein the substrate is a main board of the terminal and the antenna radiator is a metal plate having a specific pattern attached to the surface of the main board or a flexible printed circuit on which a specific pattern is formed.

8. The multiband antenna of claim 1, wherein the first antenna radiator has a length of λ/4.

9. A portable terminal, comprising:

an antenna including:

a substrate having a ground area and a non-ground area on each of a front surface and an opposite surface thereof; and an antenna radiator comprising:

a first antenna radiator disposed on the non-ground area of the front surface of the substrate, having a first end branched off into two parts on the front surface so that one part is used for power feeding and the other part is electrically connected to the ground area of the front surface, the first antenna radiator having a portion that extends from the first end towards an opposite end;

a second antenna radiator disposed on the non-ground area of the opposite surface, and continuous from the opposite end of the first antenna radiator through a via in the substrate; and a third antenna radiator on the opposite surface, driven through coupling from the second antenna radiator, the third antenna radiator aligned with the one part used for power feeding and having one end separated by a specific interval for coupling with an end portion of the second antenna radiator to extend a bandwidth of the multiband antenna;

wherein the first and second antenna radiators are arranged to overlap to form a loop structure with respect to one another, the loop structure defining only a single loop forming a central region that is devoid of the first and second antenna radiators on the front and opposite surfaces of the substrate.

10. The terminal of claim 9, wherein the loop structure is a rectangular loop structure, and the loop structure is configured to improve a high band resonance condition of the second antenna radiator.

11. The terminal of claim 9, wherein the third antenna radiator comprises a first portion in a position superposed to a feeding pattern branched off from the first antenna radiator formed on the front surface of the substrate and a second portion superposed to the portion of the first antenna radiator that extends from the first end to the opposite end by being bent at the first portion.

12. The terminal of claim 9, wherein the first antenna radiator has a length of λ/4.

13. The terminal of claim 12, wherein the substrate is a main board of the terminal and the antenna radiator is configured with a pattern which has a specific width and a specific length that is patterned together when the main board is formed.

14. The terminal of claim 12, wherein the substrate is a main board of the terminal and the antenna radiator is a metal plate having a specific pattern attached to the surface of the main board or a flexible printed circuit on which a specific pattern is formed.

15. The terminal of claim 9, wherein the opposite end of the first antenna radiator has a section bent from the portion extending from the first end towards the opposite end, the portion extending in a widthwise direction of the terminal and ending at a location of the via, and the second antenna radiator is in the form of a first section extending from the via in the widthwise direction of the terminal, a central section bent from the first section and extending to a position coinciding with the portion of the first antenna radiator so as to form the loop structure, and a third section bent from the central section.

* * * * *

UNITED STATES PATENT AND TRADEMARK OFFICE

CERTIFICATE OF CORRECTION

PATENT NO. : 8,988,286 B2
APPLICATION NO. : 12/852568
DATED : March 24, 2015
INVENTOR(S) : Jung-Ho Ahn et al.

It is certified that error appears in the above-identified patent and that said Letters Patent is hereby corrected as shown below:

In the Claims,

Column 7, Claim 9, Lines 27-28 should read as follows:
--…bandwidth of the antenna…--

Signed and Sealed this
Sixteenth Day of June, 2015

Michelle K. Lee

Michelle K. Lee
*Director of the United States Patent and Trademark Office*